US005340610A

United States Patent [19]

Thompson

[11] Patent Number: 5,340,610

[45] Date of Patent: Aug. 23, 1994

[54] METHOD OF SPLATTER PAINTING A ROTATING OBJECT

[76] Inventor: Andrew L. Thompson, 1911 Juno Rd., Juno, Fla. 33408

[21] Appl. No.: 199,090

[22] Filed: Feb. 22, 1994

[51] Int. Cl.[5] ..... B05D 5/06

[52] U.S. Cl. ..... 427/267

[58] Field of Search ..... 427/262, 263, 267, 268, 427/280, 281, 510

[56] References Cited

U.S. PATENT DOCUMENTS 4,837,056 6/1989 Easley ..... 427/262

4,988,542 1/1991 Kiapos et al. ..... 427/262

*Primary Examiner*—Terry J. Owens

*Attorney, Agent, or Firm*—Jack N. McCarthy

[57] ABSTRACT

An object is splatter painted by painting the object with a basic paint, coating the painted surface with a clear polymer, rotating and heating the object, applying paint to the clear polymer coat by a slinging action while the clear polymer is still tacky to receive the paint from the slinging action and have the slung paint become imbedded in the tacky polymer coat and merge with the polymer to provide a smooth finish, allowing the slung paint to completely dry, and applying a coat of clear polymer over the completely dry surface. The paint can be slung from a pointed rod which has been dipped in a paint supply.

12 Claims, 1 Drawing Sheet

METHOD OF SPLATTER PAINTING A ROTATING OBJECT

TECHNICAL FIELD

This invention relates to a method of splatter painting objects and more particularly articles shaped as a shaft.

BACKGROUND ART

In the past, some articles have been splatter painted by merely throwing or projecting a paint onto a surface.

DISCLOSURE OF INVENTION

An object of this invention is to provide a method of splatter painting which will give a desired appearance and a smooth finish.

A further object of this invention is to clean and paint the basic surface which is allowed to dry, to be later splatter painted, to insure a proper adherence of paint and allow a finally smooth surface; when dry, the object is coated with a clear polymer and rotated for about one hour of drying time while being heated for a desired length of time to prevent any air surface bubbles from forming and remaining while the polymer is still wet and tacky. Paint is then applied in one color, or a combination of colors by flinging the paint off an elongated tool with a point after it has been vertically dipped in a paint supply, pulled out, and has paint flowing at a steady stream from the tool, onto the surface of the object while it is being turned or rotated around a desired axis.

Another object of this invention is to coat the splatter painted object twice with a clear polymer while again rotating the object.

BEST MODE FOR CARRYING OUT THE INVENTION

Figure 1:
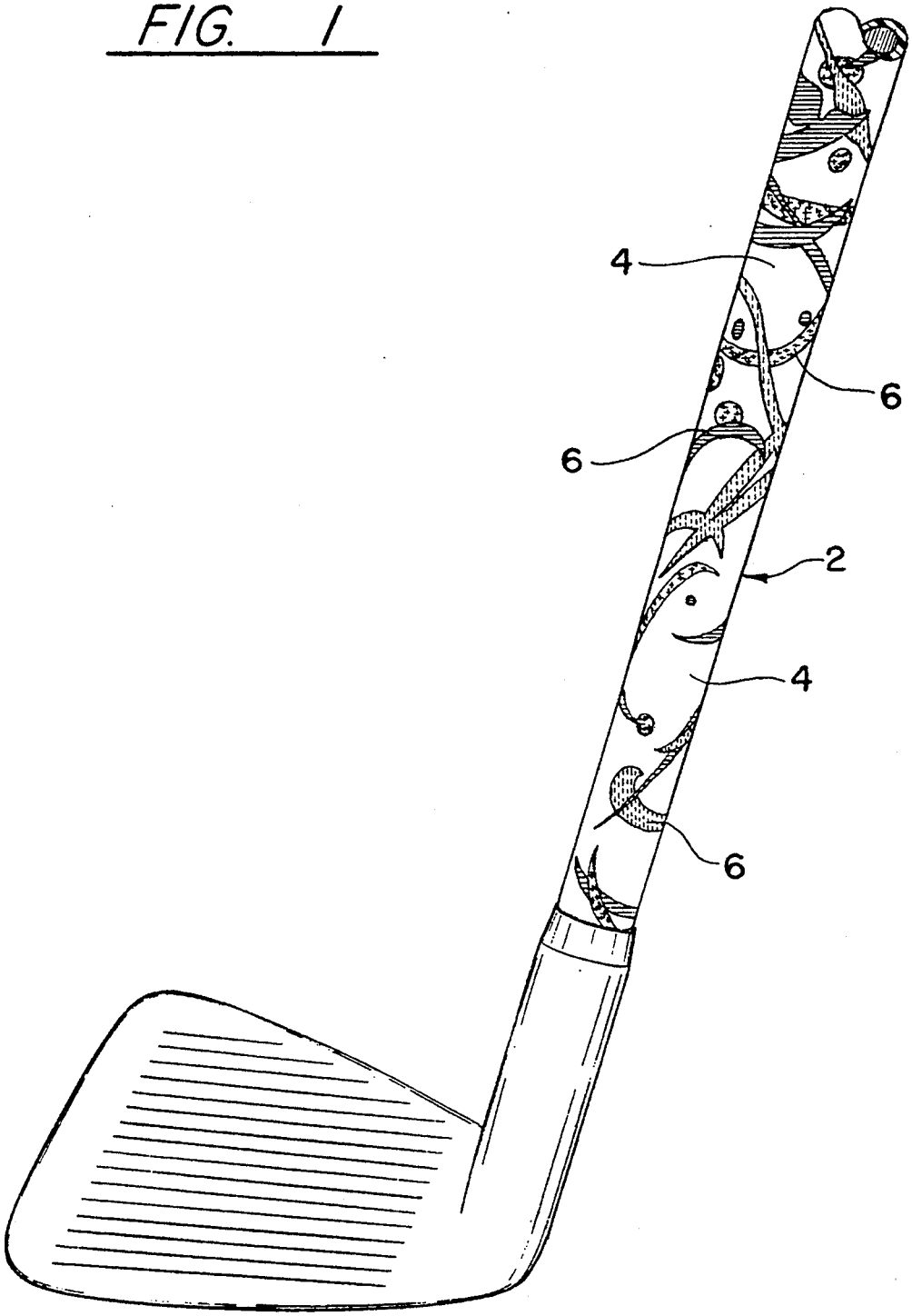
FIG. 1 is a fragmentary view of the lower portion of a golf club which has had its shaft splatter painted with a plurality of colored paints.

A method of splatter painting objects has been formed to achieve a desired appearance and feel. This method is especially adapted to rod-like objects, such as fishing rods and golf club shafts 2.

The object is first cleaned to achieve a desired smoothness. The surface of the object to be splatter painted can be sanded, and then have a basic paint 4 applied of a desired color or colors. The basic paint used should be a non-wax paint, an enamel.

When the object is dry, it is rotated and coated with a clear polymer. While 12–17 rpm is preferred, a slower or a faster speed may be used, with care being taken to avoid dripping and beading. The object is rotated about a desired axis to provide for heat being applied to the surface coated with the clear polymer along its length to reduce surface viscosity to allow any air bubbles to escape. A propane torch is desired to apply the localized heat, while other similar, clean heat sources can be used, such as a hot air gun. This provides time for the operator to inspect for air bubbles while heat is being applied. Inspect object and re-heat where necessary.

Allow approximately one hour drying time, but while the polymer is still wet and tacky, apply paint, an enamel acrylic, of any color or combination of colors 6 with a special splatter hand tool, a pointed rod, with a slinging action towards and across the object which is being rotated at its desired speed. The polymer is kept tacky to receive the paint from the slinging action to have the paint slung become imbedded in the tacky polymer coat and merge with the polymer to provide a smooth finish. The splatter hand tool is inserted in a paint supply, such as a paint can, and when the tool is taken axially up, out of the paint supply, the paint is immediately slung over the rotating object, such as a fishing rod, or a golf club shaft. When the method was used with fishing rods and golf club shafts, the rods and shafts were mounted and rotated horizontally. The paint must have a consistency to flow at a steady solid stream from the splatter tool as it is withdrawn axially from the paint supply, then the splatter tool is aimed and moved in an arc to sling the paint off of the point of the tool, across the rods and shafts. The slinging action is a reverse movement of the hand tool across the rotated object along its length at an angle to achieve the desired look.

When the splatter paint has dried to achieve complete drying, apply a first finish coat of clear polymer; reapply heat for each additional coat of clear polymer as before for the first clear polymer coat. When the first finish coat has completely dried, apply a second finish coat. Check for tacky feeling; if detected, allow for complete drying.

In a method used, rods were mounted and rotated horizontally at 15 rpm. Areas not desired to be splatter painted are masked off to use, for example, to display a logo or identifying a product. Paint applied by slinging action which does not adhere to the rotating object, passes onto a backdrop to maintain a clean working area.

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. A method of splatter painting an object comprising the sequential steps of:

(1) cleaning the surface of the object to be painted to achieve complete paint adherence;

(2) painting the surface of the object with a desired basic paint;

(3) coating the painted surface of the object with a clear polymer;

(4) rotating the object to obtain an even coat on the surface;

(5) heating the rotating surface of the object to reduce surface viscosity to allow air bubbles to escape from the clear polymer;

(6) rotating the surface of the object;

(7) applying paint to said surface of the object with a slinging action while the clear polymer is still tacky to receive the paint from the slinging action to have the paint slung become imbedded in the tacky polymer coat and merge with the polymer to provide a smooth finish;

(8) allowing the paint slung to completely dry; and (9) applying a coat of clear polymer over the completely dry surface.

2. A method of splatter painting an object as set forth in claim 1, wherein the object is cylindrical and in step (4) said cylindrical object is rotated horizontally about its axis.

3. A method of splatter painting an object as set forth in claim 1 wherein:

in step (4) said object is rotated at an rpm in the range of 12–17.

4. A method of splatter painting a cylindrical object as set forth in claim 2 wherein:

in step (4) said cylindrical object is rotated at 15 rpm.

5. A method of splatter painting a cylindrical object as set forth in claim 2 wherein:

in step (4) said cylindrical object is rotated at an rpm in the range of 12–17.

6. A method of splatter painting an object as set forth in claim 1 wherein:

in step (5) the rotating surface is heated with a localized heat.

7. A method of splatter painting objects as set forth in claim 6 wherein:

in step (5) the localized heat is applied with a propane torch.

8. A method of splatter painting objects as set forth in claim 1 wherein:

in step (7) said slinging action involves (A) dipping a pointed rod in a paint supply;

(B) pulling the rod vertically upward, forming a stream of paint falling from the pointed rod; and (C) immediately slinging the stream of paint across the surface of the object.

9. A method of splatter painting a rod comprising the sequential steps of:

(1) cleaning the surface of the rod to be painted to achieve complete paint adherence;

(2) painting the surface of the rod with a desired basic paint;

(3) coating the painted surface of the rod with a clear polymer;

(4) rotating the rod horizontally to obtain an even coat on the surface;

(5) heating the rotating surface of the rod to reduce surface viscosity to allow air bubbles to escape;

(6) allowing drying time until the polymer surface becomes tacky;

(7) rotating the rod;

(8) applying paint to the rotating surface of the rod with a slinging action while the clear polymer is still tacky to receive the paint from the slinging action to have the paint slung become imbedded in the tacky polymer coat and merge with the polymer to provide a smooth finish;

(9) allowing paint slung on said rod surface to completely dry, then

(10) applying a clear coat of polymer.

10. A method of splatter painting a rod as set forth in claim 9 wherein:

in step (4) said rod is rotated at an rpm in the range of 12–17; and in step (7) the rod is rotated horizontally.

11. A method of splatter painting a rod as set forth in claim 9 including:

(11) rotating the rod horizontally to obtain an even coat on the surface;

(12) heating the rotating surface of the rod to reduce surface viscosity to allow air bubbles to escape.

12. A method of splatter painting a rod as set forth in claim 11 wherein:

in step (4) the rod is rotated at an rpm in the range of 12–17; and in step (7) the rod is rotated at an rpm in the range of 12–17.

* * * * *